US005533872A

United States Patent [19]

Fujii et al.

[11] Patent Number: 5,533,872

[45] Date of Patent: Jul. 9, 1996

[54] RECIPROCATING PISTON COMPRESSOR

[75] Inventors: Toshiro Fujii; Kazuaki Iwama; Yuichi Kato; Katsuya Ohyama, all of Kariya, Japan

[73] Assignee: Kabushiki Kaisha Toyoda Jidoshokki Seisakusho, Kariya, Japan

[21] Appl. No.: 463,206

[22] Filed: Jun. 5, 1995

[30] Foreign Application Priority Data

Jun. 7, 1994 [JP] Japan ..... 6-125450

[51] Int. Cl.[6] ..... F04B 27/08

[52] U.S. Cl. ..... 417/269; 137/599.2

[58] Field of Search ..... 417/269, 270, 417/307; 137/855, 599.2; 91/499, 502

[56] References Cited

U.S. PATENT DOCUMENTS 5,385,451 1/1995 Fujii et al. ..... 417/269
5,393,205 2/1995 Fujii et al. ..... 417/269

FOREIGN PATENT DOCUMENTS 350135 3/1922 Germany .
579456 3/1993 Japan .
6058249 3/1994 Japan ..... 417/269
6264866 9/1994 Japan ..... 417/269

*Primary Examiner*—Charles Freay
*Attorney, Agent, or Firm*—Brooks Haidt Haffner & Delahunty

[57] ABSTRACT

A rotary valve is supported on a rotary shaft for an integral rotation. The rotary valve has a suction passage and a discharge passage. The suction passage connects a cylinder bore with a suction chamber according to the rotation of the rotary valve when a piston is in the suction stroke. The discharge passage connects the cylinder bore with a discharge chamber according to the rotation of the rotary valve when the piston is in the discharge stroke. The discharge passage includes a first passage and a second passage. The second passage communicates with the cylinder bore after the first passage has communicated with the cylinder bore after the first passage has communicated with the cylinder bore according to the rotation of the rotary valve. A discharge valve is mounted on the rotary valve. The discharge valve selectively opens and closes the first passage according to the difference between the pressures in the cylinder bore and in the discharge chamber.

20 Claims, 4 Drawing Sheets

RECIPROCATING PISTON COMPRESSOR

BACKGROUND OF THE INVENTION

1. Field of the Invention

The present invention relates to a reciprocating piston compressor such as a swash plate type compressor. More specifically, the present invention relates to a compressor which can constantly perform appropriate discharging actions irrespective of the compression ratio.

2. Description of the Related Art

Reciprocating piston compressors are generally used for air-conditioning passenger compartments in vehicles. In the typical reciprocating piston compressor, a swash plate is supported on a drive shaft, and the wobbling motion of the swash plate caused by rotation of the drive shaft is converted to reciprocating motion of the pistons. With the reciprocating motion of the pistons, gas is sucked from a suction chamber to each cylinder bore, is compressed, and is discharged to a discharge chamber.

Japanese Unexamined Patent Publication No. Hei 5-79456 discloses such a compressor in which a front housing 100 is fixed to the front end of a cylinder block 101 as shown in FIG. 6. A rear housing 106 is fixed to the rear end of the cylinder block 101 with a valve plate 105 interposed therebetween. A drive shaft 103 is rotatably supported in a supporting hole 102 of the cylinder block 101. A swash plate 99, which is fitted on the drive shaft 103, wobbles when the drive shaft 103 is rotated. The cylinder block 101 contains a plurality of cylinder bores 104 formed around the drive shaft 103. A piston 108 is located in each cylinder bore 104 and connected via a piston rod 98 to the swash plate 99.

A suction chamber 107 and a discharge chamber 109 are formed in the rear housing 106. Discharge ports 110, which are formed in the valve plate 105, allow the cylinder bores 104 to communicate with the discharge chamber 109. A flapper type discharge valve 111 and a retainer 112 are applied to the valve plate 105 on the discharge chamber (109) side in association with the corresponding discharge port 110. The discharge valve 111 opens or closes the associated discharge port 110 depending on the difference between the pressure in the cylinder bore 104 and the pressure in the discharge chamber 109 (hereinafter referred to as the discharge pressure). The retainer 112 regulates the aperture of the discharge valve 111.

A communication passage 113 is formed between the supporting hole 102 and each cylinder bore 104. A rotary valve 114, which is contained in the supporting hole 102, is connected to the rear end of the drive shaft 103 to be rotatable integrally therewith. The rotary valve 114 contains a suction passage 115 and a discharge passage 116.

Wobbling of the swash plate 99 caused by the rotation of the drive shaft 103 is transmitted to pistons 108 via the piston rods 98 to allow the pistons 108 to reciprocate in the cylinder bores 104. Suction of a refrigerant gas into the cylinder bores 104, compression of the refrigerant gas in the cylinder bores 104 and discharge of the compressed gas are achieved by the reciprocating motion of the pistons 108.

More specifically, with the rotation of the rotary valve 114 in synchronization with the drive shaft 103, communication is established between the communication passages 113 of the respective cylinder bores 104 in which the piston 108 is in the suction stroke and the suction chamber 107 via the suction passage 115 of the rotary valve 114 for a predetermined time. Thus, the refrigerant gas in the suction chamber 107 is sucked into the cylinder bores 104 sequentially. Further, after the refrigerant gas is compressed by the pistons 108, communication is established for a predetermined time, via the discharge passage 116 of the rotary valve 114, between the discharge chamber 109 and the communicating passage 113 of the cylinder bore 104 in which the piston 108 is in a predetermined discharge stroke at a certain time. It should be noted here that the certain time is when the pressure in the cylinder bore 104 reaches a predetermined value. This value corresponds to the pressure required in the cylinder bore 104 when the compressor is driven at a high compression ratio, i.e., the discharge pressure when the compressor is driven at a high compression ratio.

For example, when the discharge pressure is high and the compressor is driven at a high compression ratio, the communication between the cylinder bore 104 and the discharge chamber 109 is established after the pressure in the cylinder bore 104 is substantially equilibrated with the high discharge pressure, and thus the refrigerant gas in the cylinder bore 104 can securely be discharged to the discharge chamber 109. Therefore, in this compressor, the cylinder bore 104 does not communicate with the discharge chamber 109 before the pressure in the cylinder bore 104 is sufficiently increased so that the refrigerant gas does not flow back from the discharge chamber 109 into the cylinder bore 104.

When the discharge pressure is low and the compressor is driven at a low compression ratio, the discharge valve 111 opens when the pressure in the cylinder bore 104 becomes slightly higher than the discharge pressure, and the refrigerant gas in the cylinder bore 104 is discharged through the discharge port 110 to the discharge chamber 109. In other words, in the situation where the pressure in the cylinder bore 104 greatly exceeds the discharge pressure before communication is established between the communication passage 113 and the discharge chamber 109 via the discharge passage 116, the discharge valve 111 opens to prevent the pressure in the cylinder bore 104 from increasing unnecessarily. Accordingly, the compressor does not perform useless compressing actions to cause pressure loss.

As described above, when the above compressor is driven at a high compression ratio, the refrigerant gas is discharged through the discharge passage 116 of the rotary valve 114 which is rotated integrally with the drive shaft 103. Accordingly, the rotary valve is free from the problems of noise and fatigue, typical in flapper type valves, caused by the opening and closing of the valve. Further, when the compressor is driven at a low compression ratio, the refrigerant gas is discharged through the flapper type discharge valve 111, which opens depending on the difference between the pressure in the cylinder bore 104 and the discharge pressure. Accordingly, pressure loss, which is caused when the refrigerant gas is discharged using the rotary valve 114 only, does not occur.

However, in the above-described compressor, one discharge valve 111 is required for each cylinder bore 14. In addition, the valve plate 105 must be placed between the cylinder block 101 and the rear housing 106 so as to position the discharge valves 111. Also, a retainer 112 must be employed for each discharge valve 111. Accordingly, a number of extra parts in addition to the rotary valve 114 are required, which not only adds to the cost but complicates the structure. Consequently, not only are production costs elevated, but assembly becomes laborious and the compressor is enlarged.

SUMMARY OF THE INVENTION

It is a primary objective of the invention to provide a compressor which can constantly perform discharging actions properly irrespective of the level of compression ratio.

It is another objective of the invention to provide a compressor which requires reduced number of parts and can achieve simplification of the structure and downsizing.

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiments taken in conjunction with the accompanying drawings in which:

DETAILED DESCRIPTION OF THE PREFERRED EMBODIMENT

A double-headed piston type swash plate compressor according to the preferred embodiment will be described referring to FIGS. 1 to 5.

Figure 1:
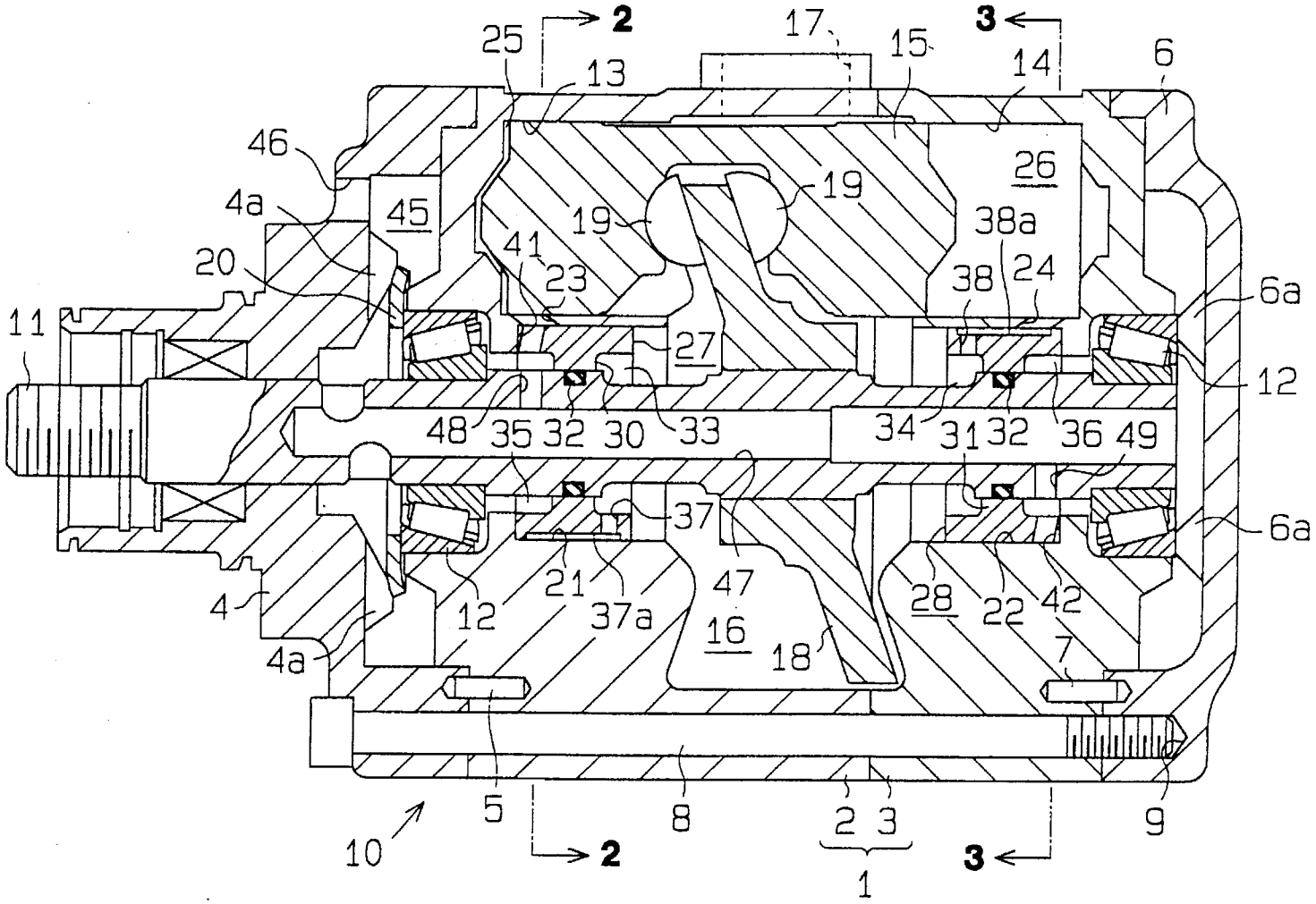
FIG. 1 shows in vertical cross section an entire view of a double-headed piston type swash plate compressor according to a preferred embodiment of the invention.

As shown in FIG. 1, a cylinder block 1 is structured by combining two blocks 2 and 3. A front housing 4 is fixed to the front end of the cylinder block 1 and positioned by a pin 5 with respect to the cylinder block 1. A rear housing 6 is fixed to the rear end of the cylinder block 1 and positioned by a pin 7 with respect to the cylinder block 1. A plurality of bolts 8 are screwed from the front surface of the front housing 4 into threaded holes 9 defined on the rear housing 6 to secure the front housing 4, cylinder block 1 and rear housing 6 to one another. The cylinder block 1, front housing 4 and rear housing 6 constitute a housing 10.

A drive shaft 11 is rotatably supported between the end portions of the cylinder block 1 with a pair of bearings 12 having conical rollers. Holding protrusions 4*a*, 6*a* are formed on the inner wall surfaces of the front housing 4 and rear housing 6, respectively. The holding protrusion 6*a* on the rear housing 6 is abutted against the outer ring of the rear bearing 12. A conical disc spring 20 is located between the holding protrusion 4*a* of the front housing 4 and the outer ring of the front bearing 12 and is compressed therebetween. The conical disc spring 20 applies an axial pre-load to the drive shaft 11.

Figure 2:
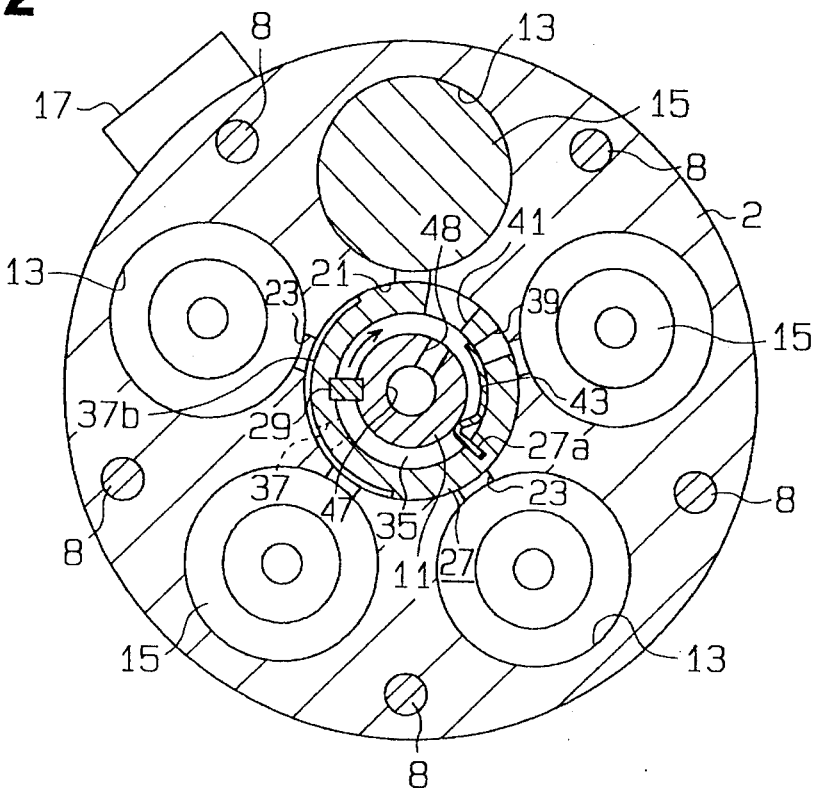
FIG. 2 is a cross section taken along the line 2—2 of FIG. 1.
Figure 3:
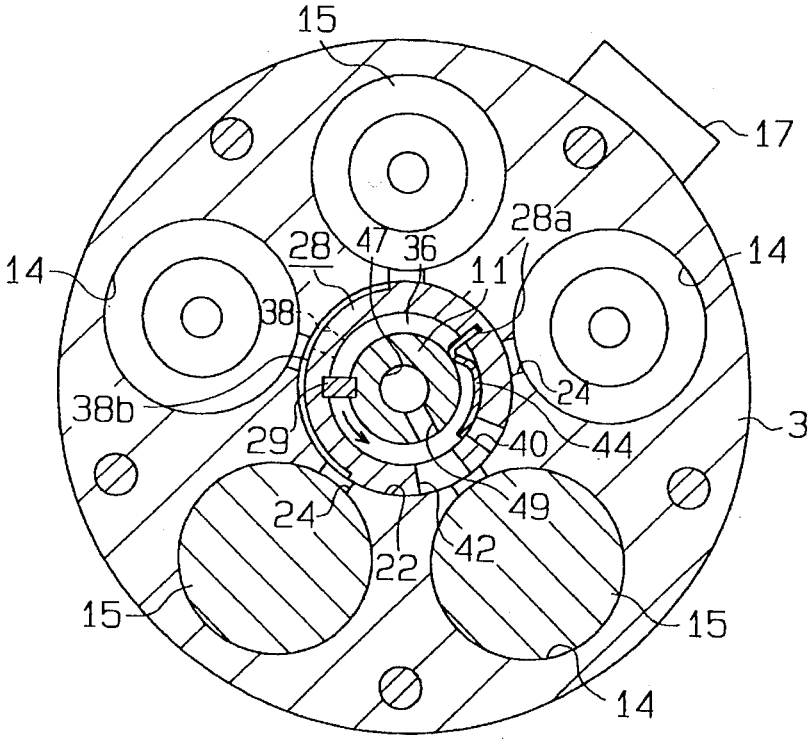
FIG. 3 is a cross section taken along the line 3—3 of FIG. 1.
Figure 4:
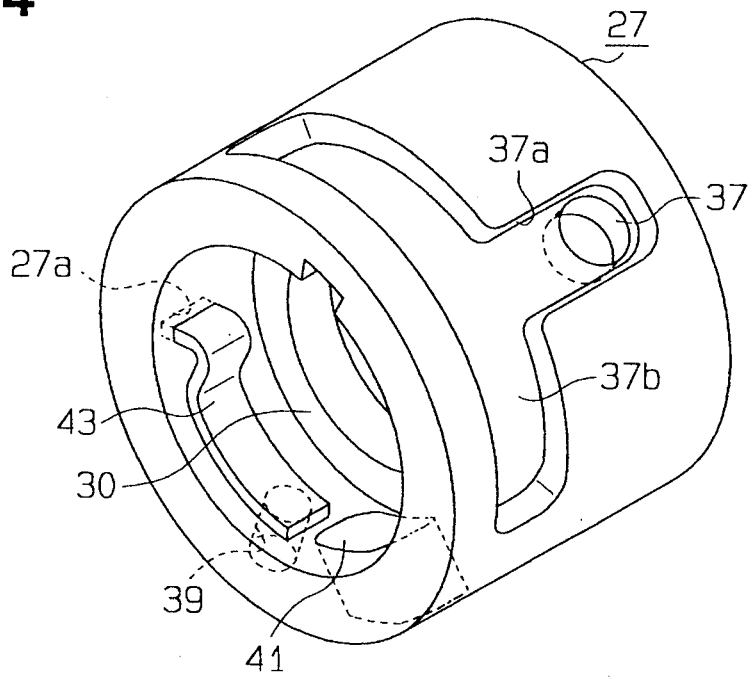
FIG. 4 shows an enlarged perspective view of a rotary valve.
Figure 5:
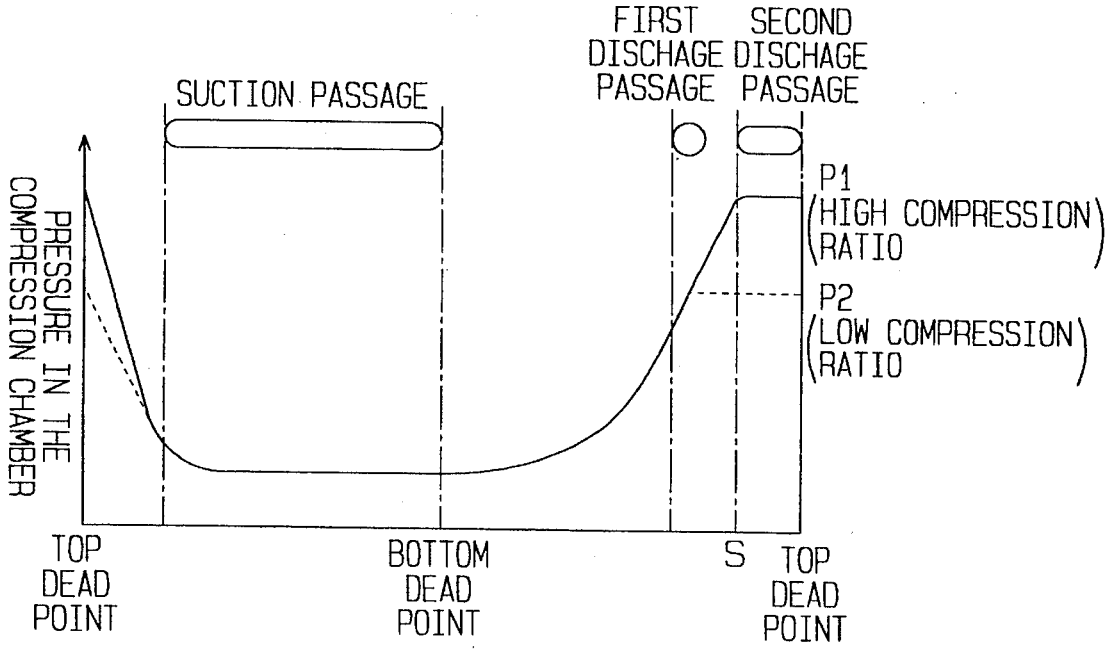
FIG. 5 is a graph showing change in the pressure of a refrigerant gas in the compression chamber.
Figure 6:
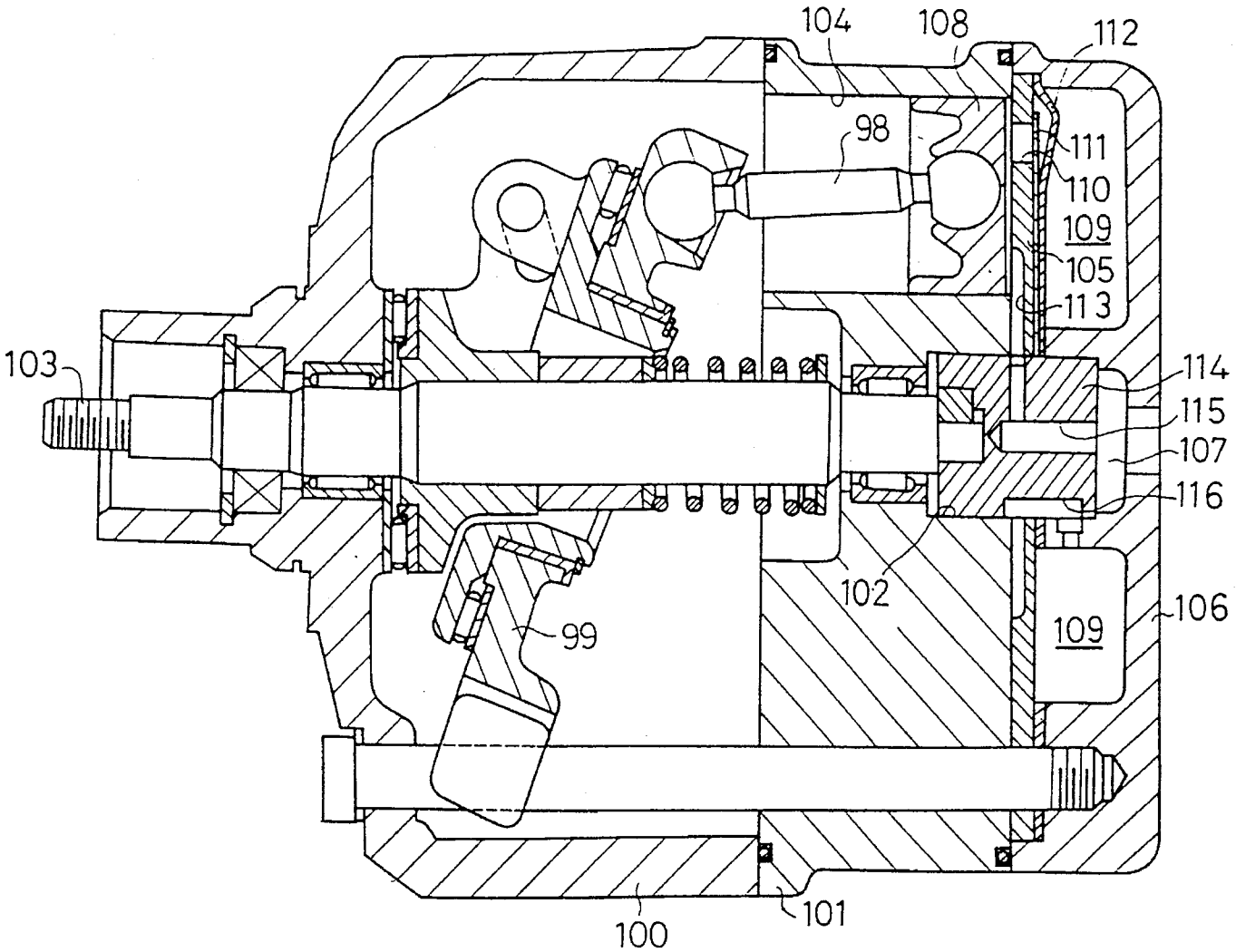
Fig. 6 (Prior Art)
FIG. 6 is a vertical cross-sectional view of a prior art swash plate compressor.

As shown in FIGS. 1 to 3, pairs of cylinder bores each consisting of a front bore 13 and a rear bore 14 are defined in the cylinder block 1 at equal intervals about the axis of the drive shaft 11. A double-headed piston 15 is disposed in each pair of cylinder bores 13, 14.

A crank chamber 16 is formed in the cylinder block 1 between the front cylinder bores 13 and the rear cylinder bores 14. To this crank chamber 16 is introduced a refrigerant gas through an inlet 17 from an external refrigerant circuit (not shown). A swash plate 18 serving as a driving plate is fixed to the drive shaft 11 in the crank chamber 16 and is connected to the middle portion of each piston 15 with a pair of hemispherical shoes 19. Accordingly, wobbling of the swash plate 18 to be caused by the rotation of the drive shaft 11 is transmitted via the shoes 19 to each piston 15 to cause each piston 15 to reciprocate.

A pair of retaining chambers consisting of a front chamber 21 and a rear chamber 22 are formed in the cylinder block 1 at the centers of the blocks 2,3, respectively. Each chamber 21,22 is concentric with the axis of the drive shaft 11. The retaining chambers 21,22 communicate with the crank chamber 16. A plurality of ports 23,24 are formed between the retaining chambers 21,22 and the cylinder bores 13,14, respectively. These ports 23,24 allow compression chambers 25,26, which are defined in the cylinder bores 13,14 by the piston 15, to communicate with the retaining chambers 21,22, respectively.

A pair of rotary valves 27,28 having a substantially cylindrical form are retained in the retaining chambers 21,22 respectively, and are connected to the drive shaft 11 by keys 29. The outer circumferences of the rotary valves 27,28 contact the inner circumferences of the retaining chambers 21,22, respectively. Annular walls 30,31 are formed on the inner circumferences of the rotary valves 27,28, respectively. Seal rings 32 are located between the outer circumference of the drive shaft 11 and the inner circumference of the walls 30,31. The walls 30,31 define, between the inner circumferences of the rotary valves 27,28 and the outer circumference of the drive shaft 11, first chambers 33,34 communicating with the crank chamber 16 and second chambers 35,36 adjacent to the bearings 12. The seal rings 32 provide a seal between the first chambers 33,34 and the second chambers 35,36, respectively.

As shown in FIGS. 1 to 4, suction passages 37,38 are formed in the circumferential walls of the rotary valves 27,28, respectively. Inlets of the suction passages 37,38 open to the first chambers 33,34, respectively, while outlets of the suction passages 37,38 open to the outer circumferences of the rotary valves 27,28, respectively. First grooves 37*a*,38*a* are formed on the outer circumferences of the rotary valves 27,28 to extend in the axial directions thereof and to communicate with the outlets of the suction passages 37,38, respectively. Second grooves 37*b*,38*b* are formed on the outer circumferences of the rotary valves 27,28 to extend in the circumferential directions thereof and to communicate with the first grooves 37*a*,38*a*, respectively. These second grooves 37*b*,38*b* are located to communicate with the ports 23,24, respectively.

First discharge passages 39,40 and second discharge passages 41,42 are formed on the circumferential walls of the rotary valves 27,28, respectively. Inlets of the discharge passages 39,41 and 40,42 open to the outer circumferences of the rotary valves 27,28 locations permitting communication with the ports 23,24 respectively. Outlets of the discharge passages 39,41 and 40,42 open to the second chambers 35,36, respectively. The first discharge passages 39,40 are formed to be narrower in the circumferential direction than the second discharge passages 41,42.

Flapper valve type discharge valves 43,44 are disposed on the inner circumferences of the rotary valves 27,28 to extend in the circumferential directions thereof in association with the first discharge passages 39,40, respectively. These discharge valves 43,44 each have crooked fixed ends which are fitted in fitting grooves 27*a*,28*a* formed on the inner circumference of the rotary valves 27,28 and are held tightly between the inner circumferences of the rotary valves 27,28 and the outer circumference of the drive shaft 11, respectively. Thus, the discharge valves 43,44 are secure. The free ends of the discharge valves 43,44 are designed to abut against the outer circumference of the drive shaft 11 so that the aperture of the valves 43,44 may be regulated. The discharge valves 43,44 are disposed in such a way that free ends thereof trail with respect to the rotational directions of the rotary valves 27,28.

A discharge chamber 45 is defined between the front housing 4 and the cylinder block 1. The refrigerant gas is led out of the discharge chamber 45 via an outlet 46 to the external refrigerant circuit (not shown). A discharge passage 47 is formed at the center of the drive shaft 11. The front extremity of the passage 47 communicates with the discharge chamber 45. The drive shaft 11 contains discharge ports 48,49 communicating the second chambers 35,36 with the discharge passage 47.

In the suction stroke where the pistons 15 are moved from the top dead points to the bottom dead points, the suction passages 37,38 are allowed to communicate with the ports 23,24 via the first grooves 37*a*,38*a* and second grooves 37*b*,38*b* with the rotation of the rotary valves 27,28. This communication allows the refrigerant gas in the crank chamber 16 to be sucked into the compression chambers 25,26 in the cylinder bores 13,14 via the first chambers 33,34, suction passages 37,38 and ports 23,24. Further, in this suction stroke, the first discharge passages 39,40 and the second discharge passages 41,42 are dissociated from the ports 23,24 to isolate the compression chambers 25,26 from these discharge passages 39,41 and 40,42, respectively.

Meanwhile, in the compression and discharge stroke, where the pistons 15 are moved from the bottom dead points to the top dead points, the second grooves 37*b*,38*b* dissociate from the ports 23,24 with the rotation of the rotary valves 27,28, to isolate the compression chambers 25,26 from the suction passages 37,38. The refrigerant gas in the compression chambers 25,26 is compressed by the isolation thus achieved. Then, the discharge stroke follows. In the discharge stroke, the first discharge passages 39,40 are first allowed to communicate with the ports 23,24 with the rotation of the rotary valves 27,28. During this time, the discharge valves 43,44 open or close the first discharge passages 39,40 based on the difference between the pressure of the compressed refrigerant gas in the compression chambers 25,26 and the pressure in the external refrigerant circuit or the pressure in the discharge chamber 45 (hereinafter referred to as the discharge pressure).

More specifically, when the pressure in the compression chambers 25,26 is lower than the discharge pressure, the discharge valves 43,44 are not opened. When the pressure in the compression chambers 25,26 is slightly higher than the discharge pressure, the compressed refrigerant gas in the compression chambers 25,26 pushes the discharge valves 43,44 aside to be exhausted into the second chambers 35,36 through the ports 23,24 and first discharge passages 39,40. Then, the refrigerant gas in the second chambers 35,36 flows through the discharge ports 48,49 and discharge passage 47 into the discharge chamber 45.

Further, in this discharge stroke, the second discharge passages 41,42 are then allowed to communicate to the ports 23,24 after the first discharge passages 39,40. This communication allows the compressed refrigerant gas in the compression chambers 25,26 to flow through the ports 23,24, second discharge passages 41,42, second chambers 35,36, discharge ports 48,49 and discharge passage 47 into the discharge chamber 45. The time that the second discharge passages 41,42 communicates with the ports 23,24 is designed to be the same time point S where the pressure in the compression chambers 25,26 reaches a predetermined value P1, as shown by the solid line in FIG. 5. The valve P1 corresponds to the pressure required in the compression chambers 25,26 when the compressor is driven at a high compression ratio. In other words, it corresponds to the discharge pressure when the compressor is driven at a high compression ratio.

Next, the operation of the compressor will be described.

When the compressor is actuated, in the suction stroke, the refrigerant gas in the crank chamber 16 is sucked through the first chambers 33,34, suction passages 37,38, and ports 23,24 into the compression chambers 25,26 of the cylinder bores 13,14. In the compression and discharge stroke, the refrigerant gas in the compression chambers 25,26 of the cylinder bores 13,14 is compressed by the pistons 15 and then discharged into the discharge chamber 45.

When the refrigerant gas in the external refrigerant circuit is not cooled sufficiently due, for example, to slow driving of the vehicle, the discharge pressure becomes high, and the compressor is driven at a high compression ratio. In this case, as shown by the solid line in FIG. 5, the discharge valves 43,44 do not open until the pressure in the compression chambers 25,26 exceeds the discharge pressure (corresponding to P1 in FIG. 5), even if communication is established between the first discharge passages 39,40 and the ports 23,24. Accordingly, the refrigerant gas in the compression chambers 25,26 does not escape through the first discharge passages 39,40 but is compressed fully until its pressure substantially equilibrates with the high discharge pressure.

At the time point S where the pressure in the compression chambers 25,26 substantially equilibrates with the higher discharge pressure, the second discharge passages 41,42 communicate with the ports 23,24. Thus, the compressed refrigerant gas in the compression chambers 25,26 is discharged through the ports 23,24, and second discharge passages 41,42 into the discharge chamber 45 preventing the gas from flowing back from the discharge chamber 45 into the compression chambers 25,26.

In the situation where the gas in the external refrigerant circuit is overcooled due, for example, to fast driving of the vehicle, the discharge pressure becomes low, and the compressor is driven at a low compression ratio. In this case, the discharge valves 43,44 are opened when the pressure in the compression chambers 25,26 become slightly higher than the discharge pressure (corresponding to P2 in FIG. 5) after communication is first established between the first discharge passages 39,40 and the ports 23,24. Thus, the compressed gas in the compression chambers 25,26 is discharged through the ports 23,24, and first discharge passages 39,40 into the discharge chamber 45. Accordingly, in the case where the pressure in the compression chambers 25,26 greatly exceeds the discharge pressure before communication is established between the second discharge passages 41,42 and the ports 23,24, such opening of the discharge valves 43,44 prevents the pressure in the compression chambers 25,26 from increasing unnecessarily.

Subsequently, at the time point S, the second discharge passages 41,42 communicate with the ports 23,24. Thus, the compressed refrigerant gas in the compression chambers 25,26 is discharged through the ports 23,24, and the second discharge passages 41,42 into the discharge chamber 45 with the pressure of the gas being substantially equilibrated with the discharge pressure. Accordingly, the compressor does not perform useless compressing actions to cause pressure loss.

While the operation of the compressor has been described with respect to the cases where the compressor is driven at a predetermined high compression ratio and at a predetermined low compression ratio, the compressor constantly performs appropriate discharging actions even if the compression ratio is varied from these levels. That is, discharging actions are appropriately performed irrespective of the level of the discharge pressure, i.e., the level of the compression ratio. Further, the two rotary valves 27,28 each contain one discharge valve 43,44 associated with the first discharge passages 39,40 of the rotary valves 27,28, respectively. Accordingly, unlike the prior art, discharge valves do not need to be employed for each cylinder bore. Thus, the number of discharge valves 43,44 is minimized. In addition, there is no need for valve plates between the cylinder blocks and the housings. Thus, the number of parts is reduced, and the structure of the compressor is simplified leading to a reduction in the production cost. In addition, the assembly of the compressor is simpler, and the compressor is smaller in size.

Further, the first chambers 33,34, which communicate with the crank chamber 16 via the walls 30,31 of the rotary valves 27,28, are located adjacent to the second chambers 35,36, respectively, which communicate with the discharge chamber 45. Accordingly, the suction passages 37,38 communicating with these chambers 33,35 and 34,36 and the discharge passages 39,41 and 40,42 can easily be formed in the rotary valves 27,28. In addition, the discharge valves 43,44 are located on the inner circumferential sides of the rotary valves 27,28, respectively. Consequently, the mechanisms for sucking and discharging the refrigerant gas can be made compact by locating them around the rotary valves 27,28.

Further, the discharge valves 43,44 are secured in such a way that the fixed ends thereof are fitted in the fitting grooves **27*a*,28*a* formed on the inner circumferences of the rotary valves 27,28, and they are held tightly between the inner circumferences of the rotary valves 27,28 and the outer circumference of the drive shaft 11. Accordingly, the discharge valves 43,44 can easily be fitted to the rotary valves 27,28 without using any special fasteners such as screws. Also, the motion of the free ends of the valve flaps is limited by the outer circumference of the drive shaft 11. Thus, there is no need to provide retainers for regulating the aperture of the discharge valves 43,44, and thus the number of parts is reduced and the structure of the valves 43,44 is simplified. In addition, the discharge valves 43,44 are disposed such that the free ends thereof trail with respect to the rotational directions of the rotary valves 27,28 so that the opening and closing of the discharge valves 43,44** are not interfered with by the flow of refrigerant gas.

Further, no discharge valve is needed for the second discharge passages 41,42, which merely consist of holes. Accordingly, the valves are not vibrated by the flow of gas when the gas is discharged via the second discharge passages 41,42. This allows the gas to be discharged smoothly and quietly. In addition, since the discharge valves 33,34 associated with the first discharge passages 39,40 are not opened or closed constantly in the discharge stroke, fatigue and noise are reduced as much as possible.

It should be understood that the present invention is not limited to the above embodiment but may be modified and embodied as follows:

(1) the present invention may be employed in a single-headed piston type compressor;

(2) the present invention may be employed in a variable displacement compressor, in which discharge displacement can be varied according to the inclined angle of a swash plate;

(3) the present invention may be employed in a wave cam type compressor, in which a wave cam having wavy cam surfaces is used instead of a swash plate to drive pistons; or (4) Each of the rotary valves 27,28 may contain only one discharge passage, and the discharge valves 43,44 may be associated with the discharge passages, respectively. In this case, the discharge valves 43,44 are opened when the pressure in the compression chambers 25,26 is slightly higher than the discharge pressure to discharge the compressed gas in the compression chambers 25,26 into the discharge chamber 45. Accordingly, back flow of refrigerant gas from the discharge chamber 45 into the compression chambers 25,26 is prevented. For the same reason, pressure loss is also avoided. Consequently, the compressor can constantly perform appropriate discharging actions irrespective of the level of the discharge pressure, i.e., the compression ratio.

Therefore, the present embodiment is to be considered as illustrative and not restrictive, and the invention is not to be limited to the details given herein, but may be modified within the scope of the appended claims.

What is claimed is:

1. A compressor having a drive plate mounted on a rotary shaft for an integral rotation in a predetermined direction about an axis of the rotary shaft, and a piston coupled to the drive plate and disposed in a cylinder bore, the rotation of the rotary shaft being converted to a reciprocating movement of the piston between a top dead point and a bottom dead point in a cylinder bore to compress gas, wherein the gas is supplied from a suction chamber to the cylinder bore during a suction stroke in which the piston is driven from the top dead point to the bottom dead point, and wherein the compressed gas is discharged from the cylinder bore to the discharge chamber during compression and discharge strokes in which the piston is driven from the bottom dead point to the top dead point, said compressor comprising:

a rotary valve supported on the rotary shaft for an integral rotation;

said rotary valve having a suction passage and a discharge passage, said suction passage connecting the cylinder bore with the suction chamber according to the rotation of the rotary valve when the piston is in the suction stroke, said discharge passage connecting the cylinder bore with the discharge chamber according to the rotation of the rotary valve when the piston is in the discharge stroke; and a discharge valve mounted on the rotary valve, said discharge valve selectively opening and closing the discharge passage according to the difference between the pressures in the cylinder bore and in the discharge chamber.

2. The compressor as set forth in claim 1, wherein said discharge passage includes a first passage and a second passage, said second passage communicating with the cylinder bore after said first passage has communicated with the cylinder bore according to the rotation of the rotary valve, whereby said discharge valve selectively opens and closes said first passage.

3. The compressor as set forth in claim 1 further comprising:

a valve chamber formed around the axis the rotary shaft, said valve chamber slidably accommodating the rotary valve and including a port to communicate with the cylinder bore; and said rotary valve including an outer surface which has an outlet of the suction passage and an inlet of the discharge passage, wherein said outlet and said inlet are respectively arranged to communicate with the port.

4. The compressor as set forth in claim 3 further comprising:

said rotary valve having a shape of a hollow cylinder;

said rotary valve having an inner surface;

said rotary shaft having an outer surface apart said inner surface of the rotary valve by a space;

a ring shaped partition formed with the inner surface of the rotary valve;

a pair of chambers defined by dividing said space with the partition contacting said outer surface of the rotary shaft, said divided chambers respectively communicating with the suction chamber and discharge chamber, wherein an inlet of the suction passage includes a first opening in said inner surface of the rotary valve to communicate with one of said divided chambers, and wherein an outlet of the discharge passage includes a second opening in said inner surface of the rotary valve to communicate with the other one of the divided chambers; and said discharge valve being disposed in the rotary valve to selectively open and close said outlet of the discharge passage.

5. The compressor as set forth in claim 4 further comprising a seal member for sealing for disconnecting said pair of divided chambers in a sealing manner.

6. The compressor as set forth in claim 4, wherein said discharge valve has a fixed end which is securely clamped by said inner surface of the rotary valve and said outer surface of the rotary shaft.

7. The compressor as set forth in claim 4, wherein said discharge valve has a free end for abutting against said outer surface of the rotary shaft to regulate an opening degree of the discharge valve.

8. The compressor as set forth in claim 4, wherein said discharge valve extends along an inner periphery of the rotary valve, and wherein said discharge valve is disposed with said free end trailing with respect to a direction of the rotation of the rotary shaft.

9. A compressor having a drive plate mounted on a rotary shaft for an integral rotation in a predetermined direction about an axis of the rotary shaft, and a piston coupled to the drive plate and disposed in a cylinder bore, the rotation of the rotary shaft being converted to a reciprocating movement of the piston between a top dead point and a bottom dead point in a cylinder bore to compress gas, wherein the gas is supplied from a suction chamber to the cylinder bore during a suction stroke in which the piston is driven from the top dead point to the bottom dead point, and wherein the compressed gas is discharged from the cylinder bore to the discharge chamber during compression and discharge strokes in which the piston is driven from the bottom dead point to the top dead point, said compressor comprising:

a rotary valve supported on the rotary shaft for an integral rotation;

said rotary valve having a suction passage and a discharge passage, said suction passage connecting the cylinder bore with the suction chamber according to the rotation of the rotary valve when the piston is in the suction stroke, said discharge passage connecting the cylinder bore with the discharge chamber according to the rotation of the rotary valve when the piston is in the discharge stroke;

said discharge passage including a first passage and a second passage, said second passage communicating with the cylinder bore after said first passage has communicated with the cylinder bore according to the rotation of the rotary valve; and a discharge valve mounted on the rotary valve, said discharge valve selectively opening and closing the first passage according to the difference between the pressure in the cylinder bore and in the discharge chamber.

10. The compressor as set forth in claim 9 further comprising:

a valve chamber formed around the axis the rotary shaft, said valve chamber slidably accommodating the rotary valve and including a port to communicate with the cylinder bore; and said rotary valve including an outer surface which has an outlet of the suction passage, an inlet of the first passage and an inlet of the second passage, wherein said outlet and said inlets are respectively arranged to communicate with the port.

11. The compressor as set forth in claim 10 further comprising:

said rotary valve having a shape of a hollow cylinder;

said rotary valve having an inner surface;

said rotary shaft having an outer surface apart said inner surface of the rotary valve by a space;

a ring shaped partition formed with the inner surface of the rotary valve;

a pair of chambers defined by dividing said space with the partition contacting said outer surface of the rotary shaft, said divided chambers respectively communicating with the suction chamber and discharge chamber, wherein an inlet of the suction passage includes a first opening in said inner surface of the rotary valve to communicate with one of said divided chambers, and wherein an outlet of the first passage and an outlet of the second passage respectively include a second opening and a third opening in said inner surface of the rotary valve to communicate with the other one of the divided chambers; and said discharge valve being disposed in the rotary valve to selectively open and close said outlet of the first passage.

12. The compressor as set forth in claim 11 further comprising a seal member for sealing for disconnecting said pair of divided chambers in a sealing manner.

13. The compressor as set forth in claim 11, wherein said discharge valve has a fixed end which is securely clamped by said inner surface of the rotary valve and said outer surface of the rotary shaft.

14. The compressor as set forth in claim 11, wherein said discharge valve has a free end for abutting against said outer surface of the rotary shaft to regulate an opening degree of the discharge valve.

15. The compressor as set forth in claim 11, wherein said discharge valve extends along an inner periphery of the rotary valve, and wherein said discharge valve is disposed with said free end trailing with respect to a direction of the rotation of the rotary shaft.

16. A compressor having a drive plate mounted on a rotary shaft for an integral rotation in a predetermined direction about an axis of the rotary shaft, and a piston coupled to the drive plate and disposed in a cylinder bore, the rotation of the rotary shaft being converted to a reciprocating movement of the piston between a top dead point and a bottom dead point in a cylinder bore to compress gas, wherein the gas is supplied from a suction chamber to the cylinder bore during a suction stroke in which the piston is driven from the top dead point to the bottom dead point, and wherein the compressed gas is discharged from the cylinder bore to the discharge chamber during compression and discharge strokes in which the piston is driven from the bottom dead point to the top dead point, said compressor comprising:

a valve chamber formed around the axis the rotary shaft, said valve chamber including a port to communicate with the cylinder bore;

a rotary valve slidably accommodated in the valve chamber, and supported on the rotary shaft for an integral rotation;

said rotary valve having a suction passage and a discharge passage, said suction passage connecting the cylinder bore with the suction chamber via the port according to the rotation of the rotary valve when the piston is in the suction stroke, said discharge passage connecting the cylinder bore with the discharge chamber via the port according to the rotation of the rotary valve when the piston is in the discharge stroke;

said discharge passage including a first passage and a second passage, said second passage communicating with the cylinder bore via the port after said first passage has communicated with the cylinder bore via the port according to the rotation of the rotary valve; and a discharge valve mounted on the rotary valve, said discharge valve selectively opening and closing the first passage according to the difference between the pressures in the cylinder bore and in the discharge chamber.

17. The compressor as set forth in claim 16 further comprising;

said rotary valve having a shape of a hollow cylinder;

said rotary valve having an inner surface;

said rotary shaft having an outer surface apart said inner surface of the rotary valve by a space;

a ring shaped partition formed with the inner surface of the rotary valve;

a pair of chambers defined by dividing said space with the partition contacting said outer surface of the rotary shaft, said divided chambers respectively communicating with the suction chamber and discharge chamber, wherein an inlet of the suction passage includes a first opening in said inner surface to communicate with one of said divided chambers, and wherein an outlet of the first passage and an outlet of the second passage respectively include a second opening and a third opening in said inner surface of the rotary valve to communicate with the other one of the divided chambers;

said rotary valve including an outer surface which has an outlet of the suction passage, an inlet of the first passage and an inlet of the second passage, wherein said outlet and said inlets are respectively arranged to communicate with port; and said discharge valve being disposed in the rotary valve to selectively open and close said outlet of the first passage.

18. The compressor as set forth in claim 17, wherein said discharge valve has a fixed end which is securely clamped by said inner surface of the rotary valve and said outer surface of the rotary shaft.

19. The compressor as set forth in claim 18, wherein said discharge valve has a free end for abutting against said outer surface of the rotary shaft to regulate an opening degree of the discharge valve.

20. The compressor as set forth in claim 19, wherein said discharge valve extends along an inner periphery of the rotary valve, and wherein said discharge valve is disposed with said free end trailing with respect to a direction of the rotation of the rotary shaft.

* * * * *